United States Patent [19]

Miller

[11] 4,430,751

[45] Feb. 7, 1984

[54] SELF-SEALING VALVED BAG

[76] Inventor: Norman K. Miller, Concordville, Pa.

[21] Appl. No.: 433,246

[22] Filed: Oct. 7, 1982

Related U.S. Application Data

[63] Continuation-in-part of Ser. No. 322,536, Nov. 18, 1981.

[51] Int. Cl.[3] ..... F42B 3/00; B65D 30/24; B65D 33/14

[52] U.S. Cl. ..... 383/6; 383/44

[58] Field of Search ..... 150/9; 229/62.5

[56] References Cited

U.S. PATENT DOCUMENTS

| | | | |
|---|---|---|---|
| 2,119,895 | 6/1938 | Sutton | 150/9 X |
| 3,523,563 | 8/1970 | Mirando | 150/9 X |
| 3,783,787 | 1/1974 | Thornley et al. | 150/9 X |
| 3,806,025 | 4/1974 | Marshall | 150/9 X |
| 3,957,098 | 5/1976 | Hepworth et al. | 150/9 |

FOREIGN PATENT DOCUMENTS

| | | | |
|---|---|---|---|
| 2303795 | 8/1973 | Fed. Rep. of Germany | 229/62.5 |
| 1066427 | 4/1967 | United Kingdom | 150/9 |

*Primary Examiner*—William Price
*Assistant Examiner*—Sue A. Weaver
*Attorney, Agent, or Firm*—Robert K. Youtie

[57] ABSTRACT

A self-sealing valved bag including elongate facing outer walls periphally secured together except for an unsecured end region, an inner wall between the outer walls extending across the unsecured end region, the inner wall being secured to one outer wall partially across the unsecured end region to leave an access passageway between the inner and said one outer wall, the inner wall being secured to the other outer wall entirely across the unsecured end region to close the latter between the inner and said other outer wall, and a pocket exteriorly on an outer wall opening toward an end thereof and terminating in a closure medially of the outer walls.

7 Claims, 6 Drawing Figures

FIG.1
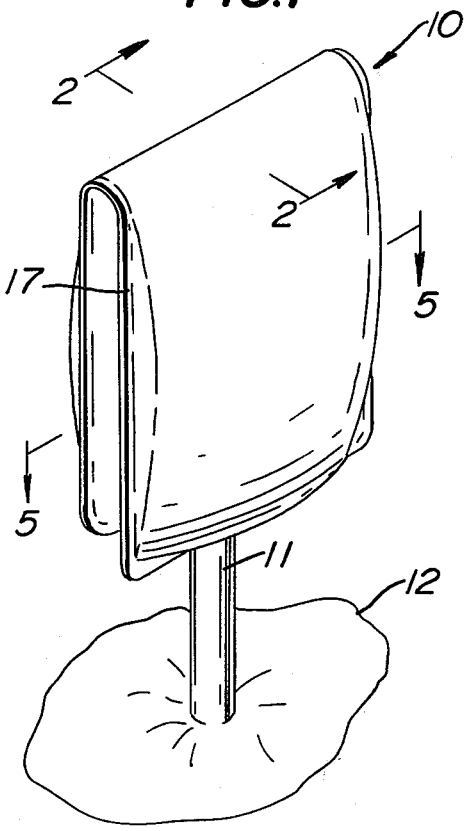
FIG.4
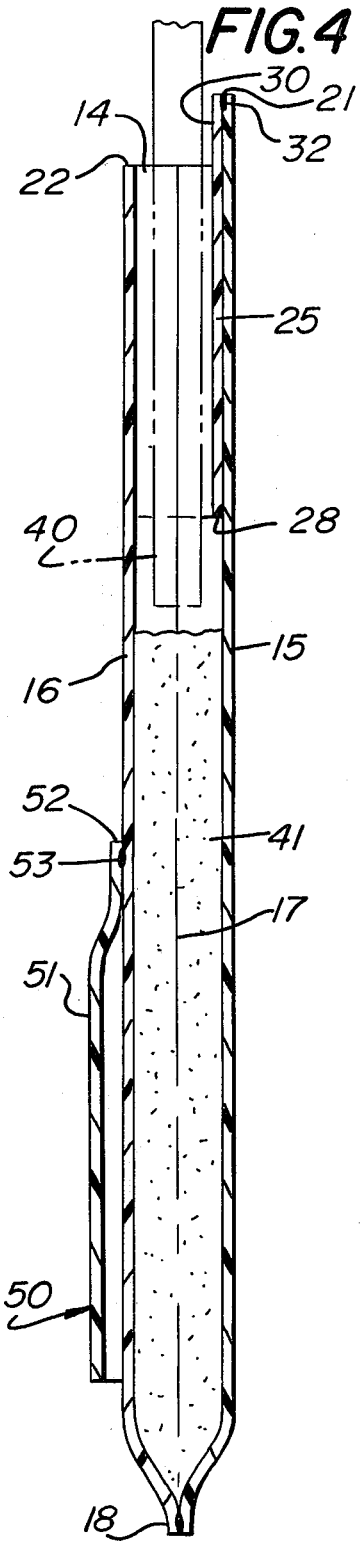
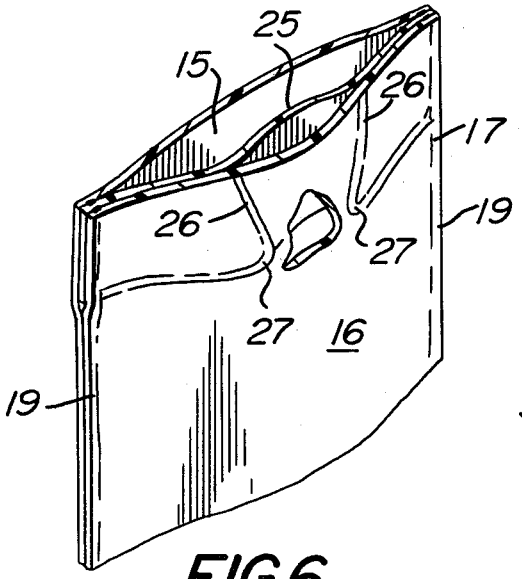
FIG.6

FIG. 2
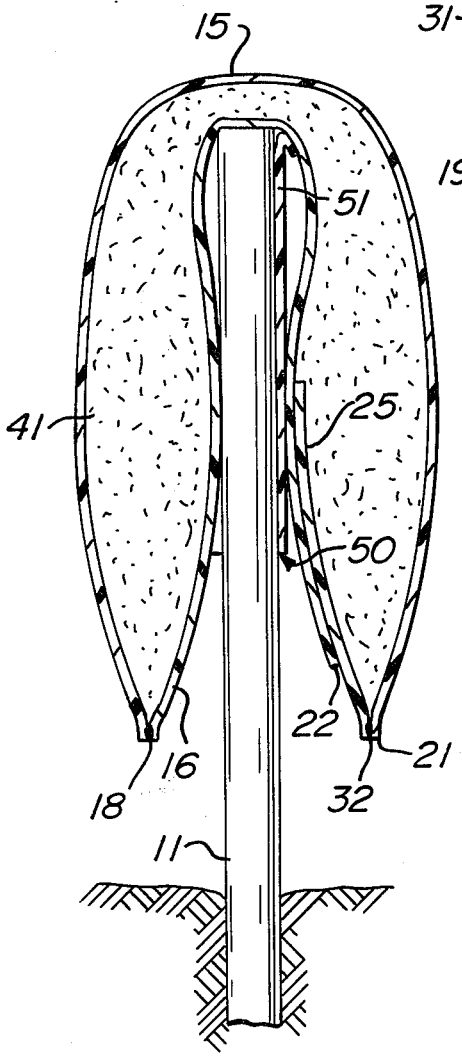
FIG. 3
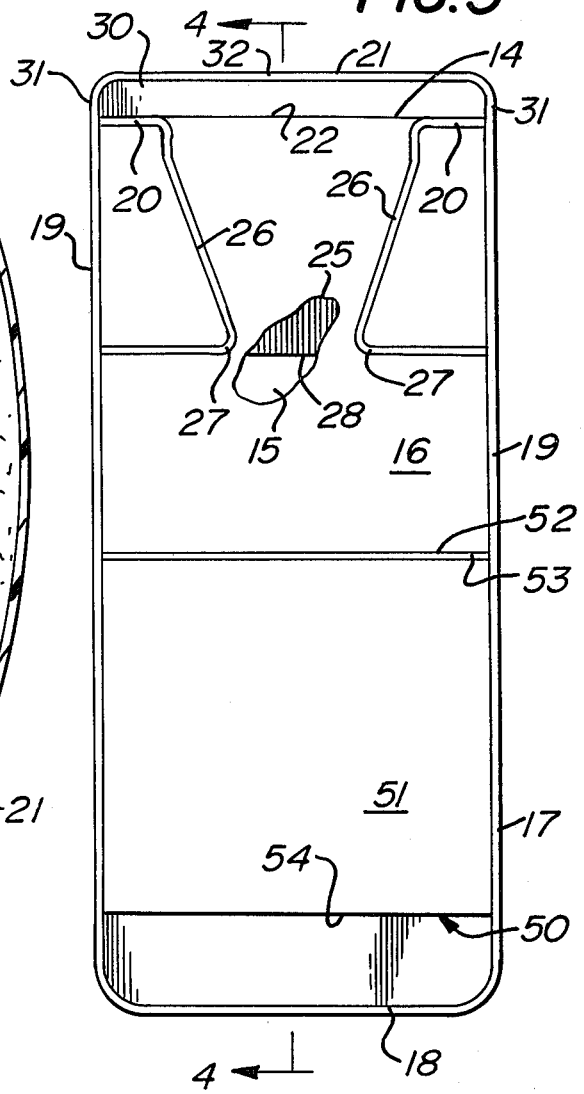
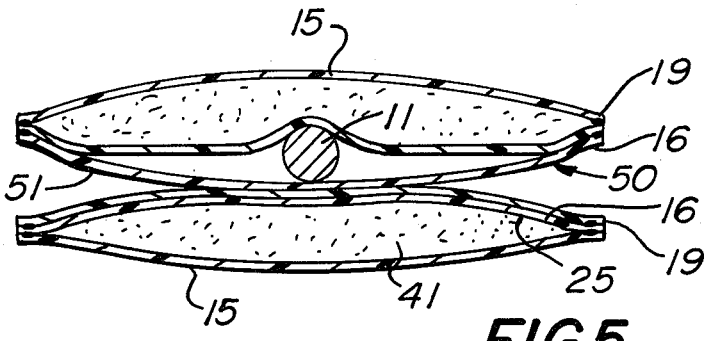
FIG. 5

SELF-SEALING VALVED BAG

CROSS-REFERENCES TO RELATED APPLICATIONS

This application is a Continuation-in-Part of my copending patent application Ser. No. 322,536 filed Nov. 18, 1981.

BACKGROUND OF THE INVENTION

The self-sealing, valved bag of the present invention has been developed and primarily employed for use in containing explosive gel for detonation thereof, and while it is described herein with particular reference thereto, it is appreciated that the bag is capable of many varied uses, all of which are intended to be comprehended herein.

In explosive gel containers of the prior art, it has been common to provide valves of normally flat rubber tubes, and various assemblies requiring metal fasteners. Such valves were wanting in reliability, sometimes tending to invert and release the contents, while containers fabricated with metallic or other separate fastener means presented serious safety hazards to personnel in the vicinity.

SUMMARY OF THE INVENTION

It is an important object of the present invention to provide a self-sealing, valved bag which overcomes the above-mentioned difficulties, eliminating the need for flexible or rubber tubing type valves and metallic or other separate fastening means, and which further provides a bag fabricated without any separate fastener means whatever and wherein a self-sealing valve is incapable of accidental opening, while permitting of quick and easy deliberate opening as for filling.

It is a further object of the present invention to provide a self-sealing valved bag of the type described, which includes the advantageous results set forth in said copending related patent application, and further wherein simple and unique pocket structure is provided in a relationship with respect to the remainder of the bag so that the bag assumes a highly stable operative position on an upstanding post or mounting member for greatly enhanced reliability on detonation.

More specifically, the present invention provides an elongate bag including an exterior pocket opening toward one end of the bag and closing medially of the bag for receiving an upstanding mounting member with the bag folded substantially in two with its medial region bent across the upper end of the mounting member and its opposite ends depending stably on opposite sides of the mounting member. By such construction the bags may be connected to electrical detonating wires or the like, and remain for relatively long periods without dislodgement from their set positions on the mounting members.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top perspective view showing a self-sealing valved bag of the present invention in its operative position set for detonation.

FIG. 2 is a sectional elevational view taken generally along the line 2—2 of FIG. 1.

FIG. 3 is a plan view of a bag of the present invention in an extended position, partly broken away to illustrate interior construction.

FIG. 4 is a longitudinal sectional view taken generally along the line 4—4 of FIG. 3, and illustrating the bag in a condition for filling, a filling conduit being shown in phantom in a filling position.

FIG. 5 is a horizontal sectional view taken generally along the line 5—5 of FIG. 1.

FIG. 6 is a partial, top perspective view of the bag, broken away to illustrate interior construction.

DESCRIPTION OF THE PREFERRED EMBODIMENT

Referring now particularly to the drawings, and specifically to FIGS. 1 and 2 thereof, a flexible container or bag of the present invention is there generally designated 10, being shown as supported by the upper end of a post or support member 11 impaled in and upstanding from a ground surface 12. The bag 10 is of elongate configuration and bent longitudinally about a midregion, so as to be folded generally in half, and supported on the post 11 with the post upstanding into the bent region and opposite ends of the bag depending on opposite sides of the post. This is a very stable position, as will appear more fully hereinafter, and has been found admirably well suited for reliably supporting filled bags in operative position for detonation.

The bag 10 of the instant invention is advantageously entirely fabricated from flexible sheet material, which may be rubber, paper or other suitable flexible sheet material, although plastic sheeting has been found preferable; and, the plastic sheeting may advantageously be secured together by conventional welding, as by heat or radio frequency, to eliminate the need for separate fasteners.

The bag 10 is best seen in FIGS. 3 and 4, being generally elongate and of generally rectangular outline configuration. The bag 10 includes a pair of generally similar, rectangular flexible sheet outer walls 15 and 16 arranged in approximately congruent, facing relation with each other. The outer walls 15 and 16 are peripherally secured together, as by welding 17 extending substantially about their peripheries, except for an unsecured end region 14, the upper end region in the illustrated embodiment.

More particularly, the outer walls 15 and 16 may be generally rectangular and disposed in generally congruent, facing relation, being secured together along their lower end margins, as at 18, and along their opposite side margins 19, 19 extending upwardly or longitudinally of the outer walls from opposite ends of the end securement 18. The outer wall 15 terminates at an upper end edge 21 spaced beyond the upper end edge 22 of the outer wall 16.

An inner wall of flexible sheet material, say plastic film or sheeting, is illustrated at 25, and is disposed in facing relation with the inner side of the outer wall 16, extending laterally thereof, across the open or unsecured region 14 between the side securements 19. The inner wall 25 extends beyond the edge 22 of the outer wall 16 to and terminates at the end edge 21 of the outer wall 15. Thus, the inner wall 25 is interposed between the outer walls 15 and 16, being located adjacent to and extending across the unsecured region 14, and is secured to the outer wall 16 by a pair of elongate securements, seals or welds 26. Extending inwardly from respective side securements 19, along the upper end edge 22 of sheet 16, there are partial end securements 20, 20 securing together the outer sheet 16 and inner sheet 25 and terminating short of each other to leave therebetween the unsecured end region 14. The unsecured region 14 may be considered to extend between the inner, adjacent ends of the partial end securements 20. In particular, the inner wall securing means or welds 26 each extend from a respective partial end securement or weld 20 longitudinally inwardly of the outer walls and in convergent relation with each other. The inner wall securements or seals 26 may be generally symmetrical about a longitudinal center line of the outer walls 15 and 16, and converging longitudinally inwardly to terminate at their inner ends 27 adjacent to and spaced from each other. The inner wall 25 may have its inner end edge 28, extending laterally of the outer walls, between the inner ends 27 of the securement means 26 and therebeyond to side edge securements 19 free of the outer walls. In practice, the inner wall 25 may be laterally coextensive with the outer walls 15 and 16, having its laterally outermost edge margins secured to the outer walls by the side securement welds 19.

The inner sheet 25 extends longitudinally of the outer sheets 15 and 16 outwardly beyond the unsecured end region 14, as at the portion 30, which portion is secured to the sheet 15 along opposite side edges by securement regions 31, 31, being extensions of securement regions 19, 19, and further secured along its extremity to the end margin of outer sheet 15 by a laterally extending securement region 32 extending between the securement regions 31.

Thus, while the inner sheet 25 is secured to one outer sheet 16, as by secured regions 20, 26, 27 and 19; the inner sheet 25 has its extending region 30 additionally secured by securement regions 31 and 32 to the outer sheet 15.

It will now be appreciated that the inner sheet 25 is secured to the outer sheet 16 except between the securement regions 26, the space therebetween defining a passageway for extension therethrough of a suitable implement, tool or tube 35, see FIG. 4, as for filling of the container with contents.

It will be appreciated that the inner sheet 25 combines with the outer sheet 16 to define a self-sealing valve construction in the same manner as said copending patent application.

The unsecured region 14 between the outer and inner walls 16 and 25, and convergent securements 26, 26 is openable for passage therethrough of a suitable implement, tube or tool 40, see FIG. 4. The open ended tube 40 may maintain fluid communication between the space between walls 15 and 16, and the exterior of the container or bag 10, permitting of convenient filling of the bag with contents 41 passing through the tube 40. Upon removal of the filled tube 40, the inner wall 25 moves into facing engagement with the inner surface of the outer wall 16, and upon bending of the filled container, as about its midregion, the contents 40 will migrate into the space between inner wall 25 and outer wall 15 to effectively seal the opening 14 against egress. Such a condition is shown in FIGS. 1 and 2.

The container 10 is provided with an exterior pocket 50 on one of the outer walls 15, 16, remote from the inner valve member or wall 25. Advantageously the pocket 50 may be provided on the outer wall 16, to which the valve member 25 is secured for its opening and closing relation.

Specifically, the pocket 50 may include a flexible, generally rectangular sheet 51 generally laterally coextensive with the outer sheet 16, having an inner end region 52 suitably secured, as by a laterally extending weld 53 to the outer surface of the outer wall 16. The longitudinally inner end 52 of the pocket sheet 51 is located generally medially of the outer sheets 15 and 16, and the inner end securement 53 extends laterally to the opposite side securements or welds 19. The side edges of the pocket sheet 51 are secured along respective side edges of the outer sheet 16 by the side securements 19; and, the outer end edge 54 of the pocket sheet is located longitudinally inwardly of the outer end securement 18. Further, the outer end edge 54 of the pocket sheet 51 is unsecured or free from the adjacent outer sheet 16, and thereby defines the pocket opening, which faces longitudinally outwardly of the container 10.

As best seen in FIGS. 2 and 5, the longitudinally outwardly opening pocket 50 is adapted to receive the upper end of support member or post 11, the post extending to the closed inner end of the pocket, so that the support member remains removably received in the pocket. With the container 10 folded over the upper end of the post 11 to locate the pocket 50 and wall 16 inwardly, and the wall 15 outwardly, it will be appreciated that the container or bag is in a gravitationally stable condition, resistant to inadvertent or accidental removal, and well adapted for electrical detonation.

That is, as the contents 41 in the operative condition of the bag 10 as shown in FIG. 2, settles gravitationally toward opposite ends of the bag well below the support location at the upper end of post 11 for substantial stability, which is enhanced by reception of the post in the pocket 50. In this condition the bags may be wired for detonation, and may reliably remain in the operative position, resistant to accidental dislodgement by wind, or other force.

From the foregoing, it is seen that the present invention provides an improved self-sealing valved bag which is extremely simple in construction, economic to manufacture and fill, and highly reliable in use.

Although the present invention has been described in some detail by way of illustration and example for purposes of clarity of understanding, it is understood that certain changes and modifications may be made within the spirit of the invention.

What is claimed is:

1. A self-sealing valved bag for fluid contents comprising a pair of elongate flexible sheet outer walls in facing relation with each other, outer walls securing means securing together said outer walls about a line configuration closed except for an unsecured region at one end of said outer walls, a flexible sheet inner wall interposed between and in facing relation with said outer walls extending generally across said unsecured region, inner wall securing means securing together said inner wall and one of said outer walls for location of said inner wall in face to face sealing engagement with said one outer wall, said inner wall securing means extending less than entirely across said unsecured region to define an access passageway communicating between the interior of said outer walls and the exterior thereof when said inner and one outer walls are displaced away from each other, additional securing means securing together said inner wall and the other of said outer walls entirely across said unsecured region, said passageway being closed by the pressure of contents in said interior urging said inner wall in sealing engagement with said one outer wall, and a mounting flap exteriorly of an outer wall and secured thereto to define a pocket extending from an opening facing longitudinally outwardly of said outer walls inwardly to and terminating in a closure longitudinally medially of said outer walls for receiving in said pocket an upstanding mounting member with said outer walls bent over the mounting member and opposite end regions of the outer walls depending stably on opposite sides of the mounting member in an operative position.

2. A self-sealing valved bag according to claim 1, said mounting flap being remote from said inner wall, for locating said mounting flap and inner wall on opposite sides of the mounting member in said operative position.

3. A self-sealing valved bag according to claim 2, said mounting flap being secured to said one outer wall, for location of said mounting flap and inner wall protectively interiorly of said other outer wall in said operative position.

4. A self-sealing valved bag according to claim 3, said mounting flap secured along opposite sides of said pocket by said outer wall securing means.

5. A self-sealing valved bag according to claim 3, said mounting flap being laterally coextensive with said outer walls and secured along opposite sides of said pocket by said outer wall securing means.

6. A self-sealing valved bag according to claim 1, said inner wall being laterally coextensive with said outer walls.

7. A self-sealing valved bag according to claim 6, said outer and inner walls and flap being generally rectangular.

* * * * *